United States Patent [19]

Branch

[11] 4,262,944

[45] Apr. 21, 1981

[54] BROCCOLI BUNCHING AND TYING MACHINE

[75] Inventor: Gregory L. Branch, Salinas, Calif.

[73] Assignee: Johnson Associates, Inc., Salinas, Calif.

[21] Appl. No.: 27,120

[22] Filed: Apr. 4, 1979

Related U.S. Application Data

[63] Continuation-in-part of Ser. No. 7,547, Jan. 30, 1979.

[51] Int. Cl.[3] ..... A01D 59/04; D04G 5/00

[52] U.S. Cl. ..... 289/2; 53/515; 289/11

[58] Field of Search ..... 289/2, 5, 11, 18.1; 53/515, 529; 83/409.1, 409.2; 100/19 R; 198/836

[56] References Cited

U.S. PATENT DOCUMENTS

| | | | |
|---|---|---|---|
| 1,454,545 | 5/1923 | Bombard et al. | 100/19 R |
| 1,502,635 | 7/1924 | Jaeger | 198/836 X |
| 2,019,080 | 10/1935 | Johnson et al. | 53/529 X |
| 2,262,035 | 11/1941 | Noling | 289/5 X |
| 2,567,052 | 9/1951 | Carruthers | 53/529 X |
| 2,722,253 | 11/1955 | Brooks | 83/409.1 |
| 3,101,963 | 8/1963 | Sullivan et al. | 289/11 |
| 3,400,959 | 9/1968 | Grillot | 289/11 X |
| 3,568,591 | 3/1971 | Dunlap | 100/7 |
| 4,041,672 | 8/1977 | Gularte | 83/409.2 X |
| 4,095,391 | 6/1978 | Arguiano | 53/515 |

FOREIGN PATENT DOCUMENTS

| | | | |
|---|---|---|---|
| 2105573 | 4/1972 | France | 83/409.2 |

*Primary Examiner*—Louis Rimrodt

*Attorney, Agent, or Firm*—Townsend and Townsend

[57] ABSTRACT

An automatic tying machine suitable for use in connection with an automatic broccoli bunching machine is illustrated. The tying machine comprises, in addition to the string carrying needle and knotter bill mechanism of the prior art machines, a placer foot that is separate from the needle, and a string retaining mechanism having two fingers, so that each string end of the loop may be independently held.

21 Claims, 14 Drawing Figures

BROCCOLI BUNCHING AND TYING MACHINE

This application is a continuation in part of my copending application Ser. No. 007,547, filed Jan. 30, 1979, entitled "Broccoli Bunching Machine".

FIELD OF THE INVENTION

This invention relates generally to food handling machines, and more specifically to a tying machine capable of tying irregularly shaped objects such as bunches of broccoli spears moving on a conveyor line.

BACKGROUND OF THE INVENTION

Certain objects such as broccoli spears are typically bound together in bunches before they are shipped to a point of sale. Automatic broccoli bunching machines are known. For example, U.S. Pat. No. 4,041,672 discloses a machine having a conveyor belt which carries a plurality of serially mounted pocket members. Each pocket member has mounted thereto a clamping mechanism comprising opposed relatively moveable clamping elements configured to assume an open vegetable receiving position as the pocket member moves past a worker stationed at the machine, and a cam portion that engages a fixed ramp downstream to cause the clamping elements to close about the inserted vegetables. The clamped bunches then pass a circular saw that cuts the stalk ends of the vegetables to a uniform length. After cutting, the stalks may be manually bound with an elastic band while the clamping portions are still held in their closed position. Broccoli spears are inserted head first to facilitate the placement of the elastic bands over the cut stalks. Thus the saw is on the same side of the conveyor as the workers.

While such an automatic bunching machine overcomes many of the problems inherent in manually bunching produce in the field or at an individual work station in a food processing plant, it does not represent the most economical way of carrying out large scale bunching in a substantially automated fashion. For example, the above referenced bunching machine is designed for carrying out a method wherein an elastic band is manually placed over the cut ends of the clamped stalks to hold the bunches together once the clamping portions are released. However, the elastic bands used in such an automated process are prohibitively expensive, their cost typically amounting to tens of thousands of dollars per year when a large scale operation is envisioned.

Automatic tying machines for tying stationary objects are known. These machines typically incorporate a knotting mechanism including rotating knotter bills. In operation, a string retaining mechanism holds the free end of a roll of string while an intermediate portion of the string passes through the eye of a string-carrying needle positioned above an object to be tied. The needle then swings in an arcuate path to a position below the object to form a loop of string thereabout. The string ends pass downwardly into a slot in a sheet metal guide overlying the knotter bills and then under the knotter bills to the retaining mechanism. The needle typically carries a placer foot rigidly attached thereto so that as the needle reaches its extreme of travel, the placer foot effectively closes the slot to define an aperture which constrains the string against lateral movement and prevents its being pushed out of the slot as the knotter bills turn to tie the knot. After the knotter bills have tied the knot, the sheet metal guide moves in a transverse direction to strip the string from the knotter bills.

The cost of string is relatively negligible compared to that of elastic bands. Thus the idea of using an automated tying machine in connection with an automatic bunching machine is attractive, since in addition to reducing labor costs, a tying machine can result in savings of the order of tens of thousands of dollars per year by eliminating the need to use elastic bands. Due to the fact that a band of string, once tied around a bunch of vegetables, has no ability to shrink further if it happens that the vegetables were not tightly bunched when the string was tied, it is important that the string be tied around the bunch as close as possible to the region at which the objects to be tied are clamped. The need to tie the bunches at a location as close as possible to the point at which the bunches are clamped is further dictated by the rather critical tolerances involved in tying a bunch of non-uniform objects that is moving along a conveyor line.

However, prior art bunching machines have generally been structurally unsuitable for use with an automatic tying machine. This unsuitability arises both from the structure of the prior art bunching machines and from the nature of the tying operation itself. The nature of known automatic tying machines is that they extend below the objects being tied and beyond the plane in which the string loop is formed. Prior art bunching machines such as the above referenced type have the clamping mechanism attached to each pocket. The provision of clamping members so disposed makes it impossible to located an automatic tying machine sufficiently close to the region of clamping to make the use of an automatic tying machine feasible. Also, prior art bunching machines having opposed clamping elements do not allow precise indexing of the tying mechanism with respect to the bunch. In order to tie a tight bunch, the string-carrying needle must come down as close to the rear of the bunch as possible. Due to non-uniformities in the bunch diameter, such prior art bunching machines only define the bunch center line and not the rear edge with precision.

Additionally, a number of difficulties have been encountered in adapting automatic tying machines for use with bunchers. These difficulties arise in part due to the need to reliably tie non-uniformly sized bunches of irregular shape. The situation is aggravated where, as in the present case, the bunches are moving. In such a situation, the placer foot mounted on the needle occasionally hits the product to be bunched, thus deflecting the needle and causing the apparatus to mistie or jam, with possible damage to the machine.

A further difficulty with prior art tying machines is that the string retaining mechanism is subject to unreliable operation due to the need to hold the two ends of the string loop securely during tying. The string retaining mechanism typically includes a clamping element that holds both ends of the loop. However, the normal tying process produces a short cut piece of string which tends to cause unreliable operation. In particular, if one of these pieces overlaps one of the string ends being held, the other end is not held securely. A similar problem arises when it is desired to use flat string. Certain shapes of objects to be tied, such as the generally tapered configuration of broccoli bunches, require the use of flat strings. Such string is prone to becoming folded along a longitudinally extending axis, so that when the single clamp is required to hold two flat strings, one of which is folded and so twice as thick, the other string end is improperly held. The presence of cut pieces of string compound this latter problem.

As mentioned above, it is important to tie a tight bunch. This requires the maintenance of proper string tension during the tying operation. In particular once the string loop is formed around the object to be tied, and the ends retained by the finger, the knotter bills take up a fixed amount of string as they turn. While it is possible to achieve reproducible results with regularly shaped objects of uniform compressibility, irregularly shaped and sized objects present a problem. If the retaining finger holds the string ends securely, the string can break or be tied too tightly, thereby injuring the possibly delicate product. If the string is not held securely, the result might simply be to pull the string out of the finger mechanism.

Therefore, while the use of an automatic tying machine in connection with automatic bunching machine is, in principle, highly advantageous, such use has not occurred, and the maximum economic benefit available from automatic bunching machines and automatic tying machines has not been realized.

SUMMARY OF THE INVENTION

The present invention provides as automatic tying machine that is especially suitable for use in connection with an automatic broccoli bunching machine. The tying machine of the present invention is able to reliably and tightly tie moving, irregularly shaped and sized bunches.

Broadly, the tying machine comprises, in addition to the string carrying needle and knotter bill mechanism of the prior art machines, a placer foot that is separate from the needle, and a string retaining mechanism having two fingers, so that each string end of the loop may be independently held. The placer foot is driven reciprocally in synchronization with the needle, but in a lagging relationship thereto. Each finger carries at one of its ends an opposing wedge that is tapered toward the axis of the finger and spaced from the finger in a hook-like configuration. A finger housing defines respective tapered slots into which each finger wedge may fit. In a so-called "open" position, the wedge is spaced from the finger housing to define an open string-receiving interval. The fingers are spring-loaded toward a so-called "closed" position wherein the finger wedges are seated in the slots so that the mating taper prevents further movement. Thus a string in the interval is wedged between the outer surfaces of the wedge and the inner surfaces of the slot when the wedge moves from its open to its closed position. In operation, one of the string ends being held under tension passes around the front surface of its respective wedge and then back between the wedge and the slot. Thus tension on the string increases the force exerted on the string by the mating surfaces of wedge and slot. The slot surfaces may be etched to provide greater frictional retention of the string. The slots are preferably configured to accomodate the fingers so that when a finger moves its wedge from its closed to its open position, as is accomplished by means of suitably configured cams, the finger itself positively ejects from the slot any string that was being held therein by the wedge.

The entire finger housing assembly is pivoted and spring loaded by a finger housing tension spring to maintain a uniform tension on the string as the knotter bills turn to tie the knot. Thus, the string is not pulled out of the slots, since once the string has been taken up and the proper tension reached, the finger housing moves.

The operation of the tying machine may be described as follows. A cycle typically begins with one end of the string clamped by a first finger wedge, and passing under the knotter bills and upwardly through the guide slot toward the tip of the needle. A product to be tied moves toward the upwardly inclined string, and as it approaches the string, the needle starts down behind the moving product to encircle it. The needle then comes under the product, passes under the knotter bills, and continues its travel past the two fingers. Prior to the arrival of the needle, the second finger (the one whose wedge was not holding the end of the string) opens so that as the needle reaches its end of travel, the finger is in position to close and clamp the string. The second finger then clamps the string and the needle starts to move back towards its original up position. This results in the string passing in front of and then back around the wedge for the increased holding force mentioned above.

The placer foot which is cam-actuated arrives to close the slot in the sheet metal guide just as the knotter bills begin to turn. The sheet metal guide carries an elongate element extending towards the placer foot to prevent the string from assuming a position behind the placer foot rather than in front of it. If the string were behind the placer foot, it would not be constrained in the aperture during the knotting operation, and a mistie would occur. As the knotter bills turn, they tend to urge the string out of the slot. Therefore it is important that the placer foot be in position at this time. In turning, the knotter bills use up a certain constant amount of string. When a set tension, determined by the finger housing tension spring, is reached, the string stops pulling tighter around the product, and the finger housing itself is pulled toward the knotter bills until the tying operation is complete. The sheet metal guide moves transversely and a knife on the guide cuts the string. The transverse movement completes the formation of the knot and strips it from the knotter bills to allow the tied product to continue its travel on the conveyor.

As the needle swings back up, thereby assuming the position it was in at the beginning of the cycle, everything is the same as at the beginning except that the second finger wedge is the one that is retaining the string end. In the next cycle, it will be the first finger that opens just prior to the passage of the needle.

It will be seen that the tying machine of the present invention provides advantages that result in more reliable operation. In particular, the provision of a separate placer foot allows the placer foot to lag behind the needle and thus stand a lesser chance of hitting the irregularly shaped product. Moreover, the placer foot is of heavier construction than the needle, and so is not deflected, even if it should hit the product. The finger mechanism including separate independently biased fingers for holding the respective string ends eliminates problems of improper string retention due to overlapping or folding. The tapered configuration of the finger wedges in cooperation with the etched finger housing slots provides for positive holding while the fingers within the slots provide positive ejection of the cut strings.

The present invention also provides a machine for bunching broccoli spears and other elongate objects that is especially well suited for use with an automatic tying machine. A first conveyor carries a plurality of downstream and upwardly opening pocket flights, each of which is adapted to receive a number of broccoli spears. The pocket flights are devoid of a dedicated bunching mechanism. The first conveyor passes under a second synchronously operated conveyor that carries a plurality of correspondingly spaced bunching arm assemblies. As a given flight passes under a corresponding bunching arm assembly, a cam follower on the bunching arm assembly engages a fixed ramp to urge a bunching arm downward and backward to urge the broccoli firmly into the rear of the pocket of the flight. The second conveyor is typically much shorter than the first and carries a correspondingly smaller number of bunching arm mechanisms than there are pocket flights. This results in a simpler, more inexpensive machine having fewer moving parts. Additionally, the pocket flights, being unencumbered by the clamping mechanism, may be configured to permit faster, more efficient loading.

The simplified structure of the pocket flights allows the bunching machine to be used with an automatic tying machine since the portions of the tying mechanism that protrude past the plane of tying may extend beneath the conveyor without encountering parts of the clamping mechanism. Thus, the tying may be carried out in a plane very close to the edge of the flight. Since the flight is relatively narrow and the bunching arm comes down at an intermediate position, the tying mechanism operates relatively close to the bunching arm.

A further advantage of using an automatic tying machine rather than having an operator slip an elastic band over the cut stalks is that the spears of broccoli may be loaded into the flights with their respective head portions toward the user and the ends to be cut on the side of the conveyor remote from the workers. This results in the circular saw being on the side of the conveyor remote from the workers, thereby improving the safety of the machine. At the same time, the tying mechanism is located on the same side of the conveyor as the user, thereby rendering it accessible for servicing, adjustment, and string reloading.

For a further description of the nature and advantages of the present invention, reference should be had to the remaining portion of this specification and to the attached drawings.

DESCRIPTION OF THE PREFERRED EMBODIMENT

Figure 1:
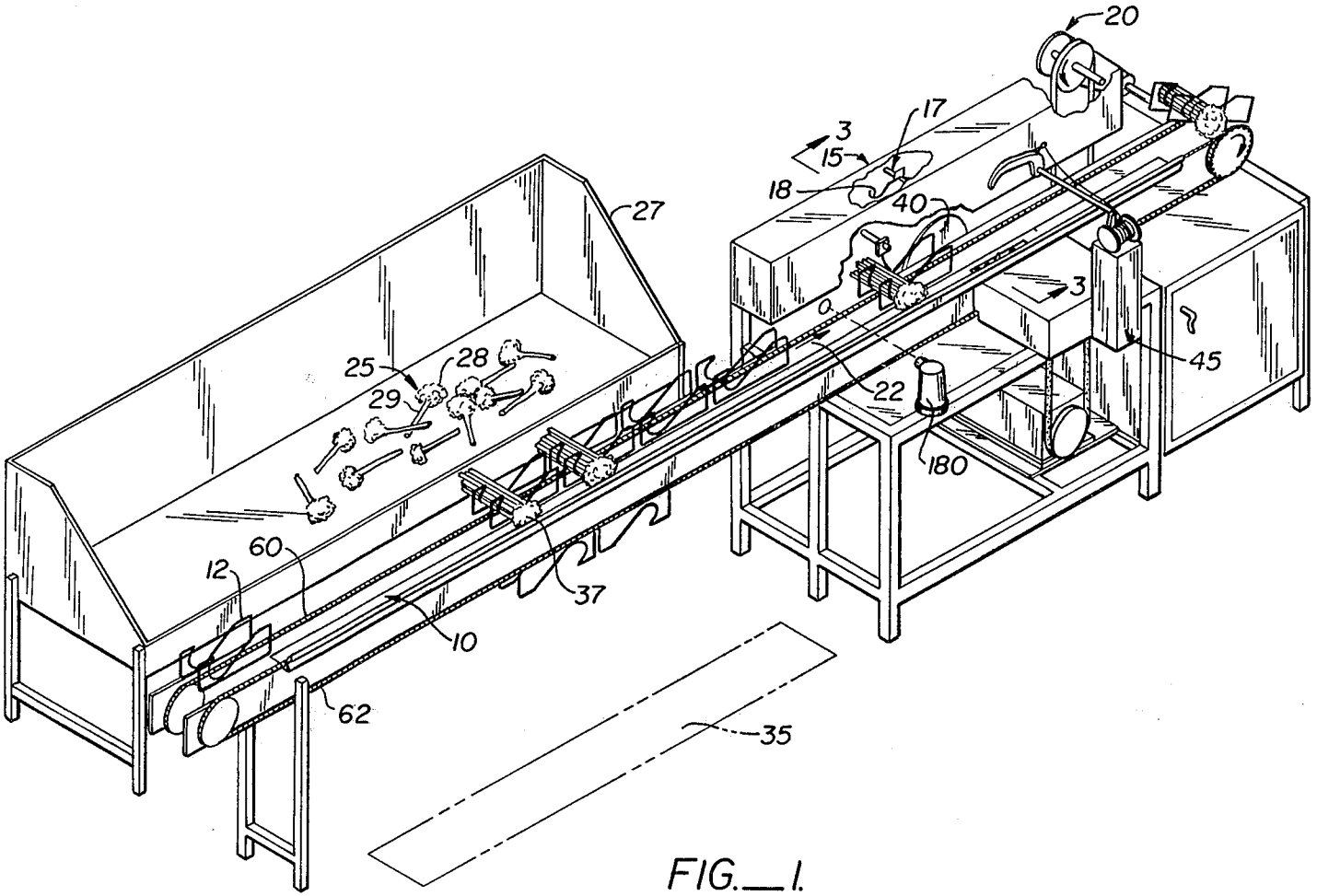
FIG. 1 is an isometric schematic view of a broccoli bunching machine according to the present invention.

FIG. 1 is an overall isometric view showing a broccoli bunching machine and a tying machine constructed according to the present invention. Broadly, the bunching machine comprises a first lower conveyor 10, a plurality of pocket flights 12 mounted serially on conveyor 10, a second upper conveyor 15, a plurality of bunching arm assemblies 17 (each having a bunching arm 18) mounted serially on conveyor 15, and motorized driving means 20 for driving conveyors 10 and 15 in a synchronized fashion. The second conveyor is generally shorter than the first and located above the downstream portion thereof. For example, conveyor 10 may carry thirty-five flights 12 while conveyor 15 carries eight bunching arm assemblies 17. Conveyors 10 and 15 are endless loops disposed in a vertical plane and elongated in a horizontal direction. Activation of driving means 20 causes the upper portion of lower conveyor 10 and the lower portion of upper conveyor 15 to move in the same direction, as indicated by arrow 22 to define a flow path. Unless otherwise specified, references to the direction of movement will be with respect to the direction of the upper portion of lower conveyor 10 (i.e. in relation to arrow 22).

In operation, a number of articles 25 to be bunched are placed in a bin 27 located near the upstream portion of conveyor 10. For definiteness, further reference to articles 25 will assume that they are broccoli spears, each having a head portion 28 and a stalk portion 29. One or more workers (not shown) are stationed in a region 35 along the upstream portion of conveyor 10 on a side remote from bin 27 and load broccoli spears 25 into pocket flights 12 transverse to the flow path. Conveyor 10 and pocket flights 12 thereupon are disposed at a convenient working height for the workers stationed at location 35. One of the workers stationed at location 35 takes the required number of spears 25 from bin 27 and places them within a given flight 12 to form a bunch 37. Since subsequent operations, to be described below, typically occur faster than the loading operation, it is common to have several workers positioned along conveyor 10 with each worker loading pocket flights at staggered intervals along conveyor 10.

As the loaded flights move along the direction of arrow 22 past area 35, they pass under second conveyor 15. Bunching arm assemblies 17 are spaced along conveyor 15 at intervals corresponding to the intervals of pocket flights 12 and the lower (facing) portion of upper conveyor 15 moves in the direction of arrow 22 at the same speed as lower conveyor 10. As a given pocket flight 12 passes under conveyor 15, a bunching arm 18 of a corresponding bunching arm assembly 17 is lowered into engagement with the broccoli bunch 37 in the given pocket flight to tightly bunch the individual spears together. Bunching arm 18 remains in the lowered bunching position for a sufficient length of travel to maintain the bunch intact as it moves past a circular saw blade 40 and an automatic tying maching 45 (to be described in detail below). Once the bunch is cut and tied, the bunching arm swings upward to release the bunch so that it may fall out of the pocket flight at the end of the conveyor's travel. A separate conveyor or bin (neither of which is shown) may be provided to receive the cut and tied bunches as they fall out of their corresponding pocket flights.

Figure 2:
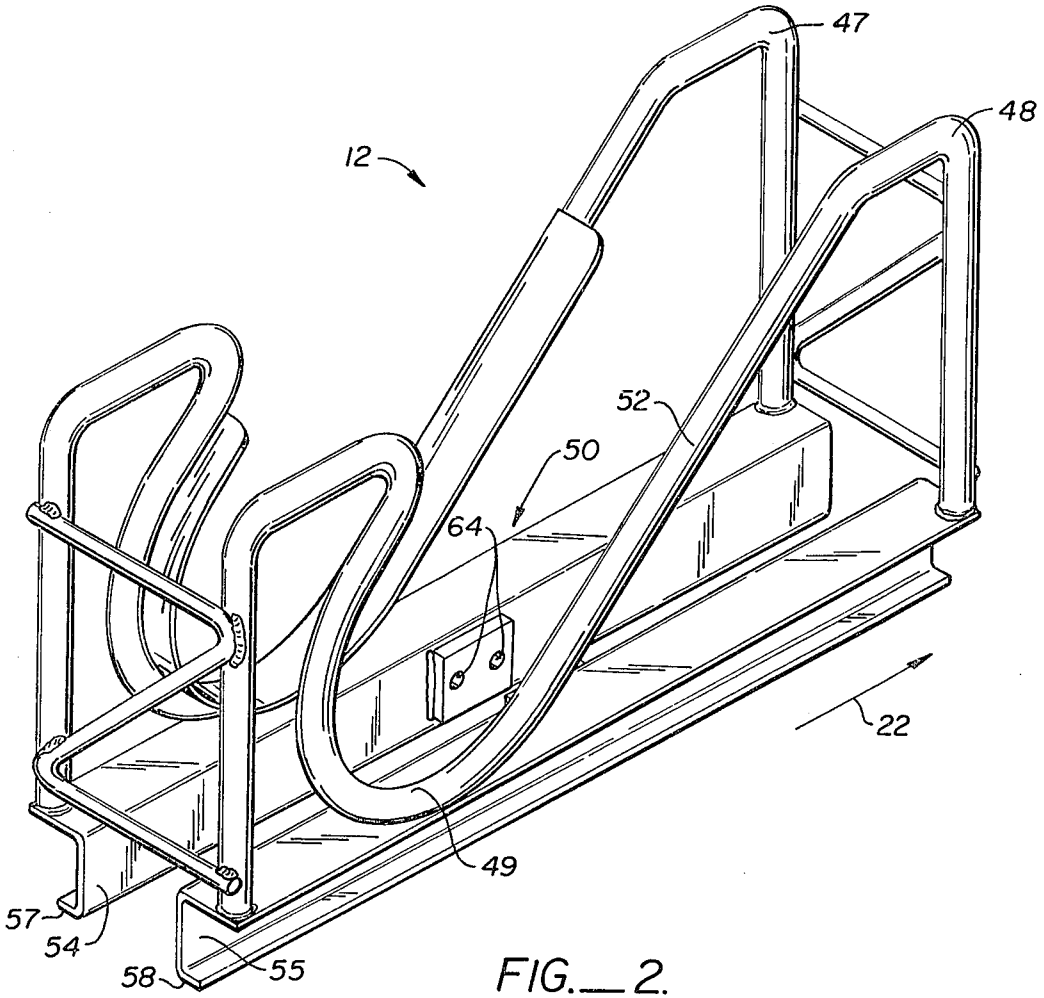
FIG. 2 is an isometric view of one of the pocket flights.

Having described the overall operation of the bunching machine of the present invention, the preferred embodiment may be set forth in greater detail. With additional reference to FIG. 2, a preferred construction for pocket flights 12 may be seen. Each pocket flight 12 comprises a pair of spaced, substantially identical frames 47 and 48, each of which lies in a vertical plane oriented along the direction of travel and shaped to define a pocket 50. With respect to the direction of motion indicated by arrow 22, frame 48 has a curved portion 49 that defines a pocket 50 that opens upwardly and downstream. An inclined portion 52 is contiguous with a lower part of curved portion 49 and extends upwardly and downstream therefrom so that as flight 12 moves along, inclined portion 52 tends to guide the objects being placed into pocket 50. Typically, the workers'motions are quite rapid and the pocket design facilitates their task. In the preferred embodiment, frames 47 and 48 are formed from metal such as 5/16-inch diameter steel rod. Frames 47 and 48 carry along their respective lower portions outwardly facing U-shaped channels 54 and 55 including lower respective outwardly extending flanges 57 and 58.

Figure 3:
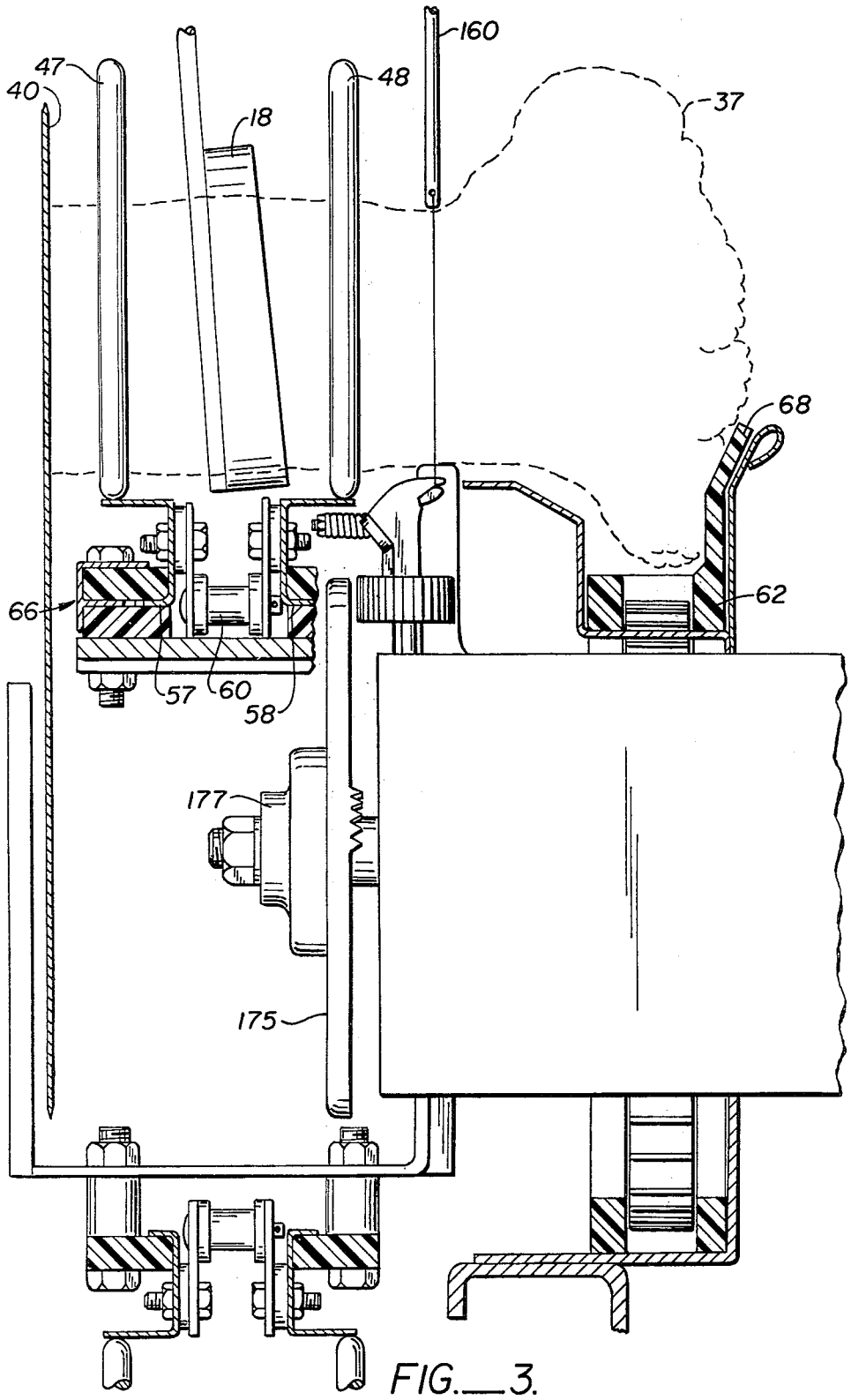
FIG. 3 is a sectional view taken along line 3—3 of FIG. 1 showing the relationship of the pocket flights, the bunching arm, and the tying mechanism.

Conveyor 10 preferably comprises a metal chain 60 and a synchronously driven plastic chain 62. As shown in FIG. 3, each pocket flight is mounted to a single link of chain 60 at an intermediate position of channels 54 and 55, each of which is provided with bolt holes 64 in its vertical web portion for this purpose. Referring also to the sectional view of FIG. 3, flanges 57 and 58 engage respective guide tracks 66 and 67 that run along the direction of travel. Plastic chain 62 runs alongside chain 60 to support the heads of the broccoli spears. Indexing of the head of the spears is facilitated by an upwardly extending plastic guide 68 attached to chain 62.

Figure 4:
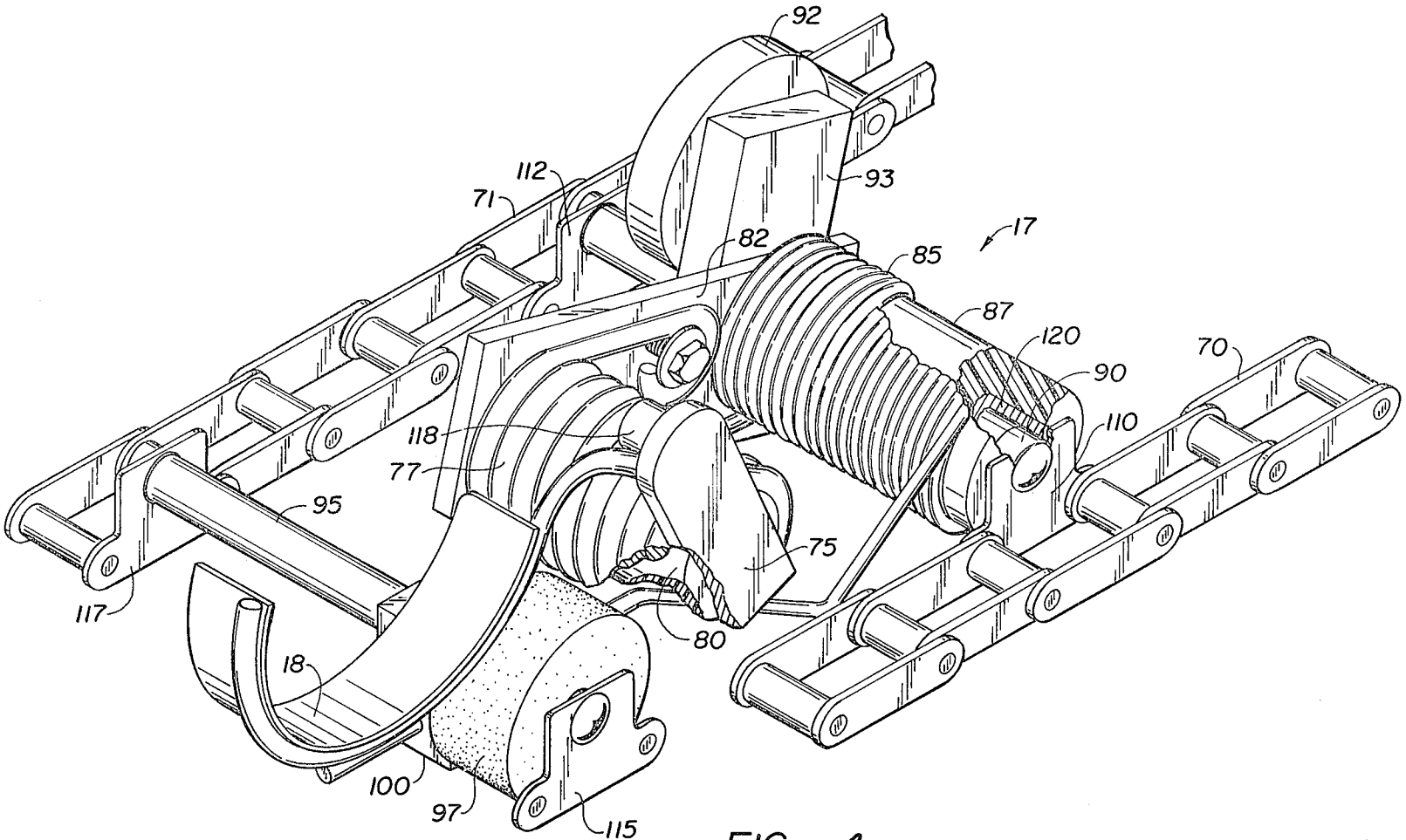
FIG. 4 is an isometric view of part of the overhead conveyor and one of the bunching arm assemblies that cooperate with the pocket flights.

FIG. 4 is an isometric view showing a bunching arm assembly 17 as disposed on the upper portion of upper conveyor 15. Upper conveyor 15 comprises spaced synchronously driven roller chains 70 and 71, each located in a vertical plane extending along the direction of arrow 22 with the respective lower portions of chains 70 and 71 traveling parallel to arrow 22 and the upper portions traveling antiparallel. Chains 70 and 71 pass over an upstream sprocket pair 72 and a downstream sprocket pair 74.

Bunching arm assembly 17 comprises, in addition to bunching arm 18, a lower arm mounting 75, a bunching arm spring 77, a bunching arm spring arbor 80, an upper arm 82, an upper spring 85, an upper arm spring arbor 87, an upper arm pivot shaft 90, a cam follower bearing 92, a cam follower arm 93, a dummy shaft 95, a stop roller 97, and a spring tail retainer 100.

Pivot shaft 90 and dummy shaft 95 are parallel and extend perpendicularly between roller chains 70 and 71 with dummy shaft 95 being displaced downstream from pivot shaft 90 with respect to the direction of travel of the roller chains. Upper arm pivot shaft 90 is mounted to corresponding links 110 and 112 of roller chains 70 and 71. Dummy shaft 95 is mounted to corresponding links 115 and 117 of roller chains 70 and 71, links 115 and 117 being correspondingly spaced from links 110 and 112.

Bunching arm 18 is an extension of bunching arm spring 77. Bunching arm spring 77 is mounted coaxially about arbor 80 with one end fixed to upper arm 82. Lower arm mounting is rigidly mounted to upper arm 82 and carries a stop pin 118 to keep spring 17 from unwinding. Spring 77 (and bunching arm 18 therewith) is preloaded to about 20 pounds force as measured at the bunching arm.

Upper arm 82 is mounted to a tubular member 120 which surrounds upper arm pivot shaft 90. Upper arm spring 85 is a coil spring mounted about upper arm spring arbor 87 which itself surrounds tubular member 120. One end of upper arm spring 85 is fixed to upper arm 82 and the other end mounted to spring tail retaining block 100 on dummy shaft 95. Thus, spring 85 provides torsional loading of upper arm 82 about upper arm pivot shaft 90. As a result of this torsional loading, upper arm 82 assumes a retracted position generally along the direction of travel. Top roller 97, preferably constructed of neoprene rubber, limits the travel of bunching arm 18 in response to the torsional loading of spring 85. Cam follower bearing 92 is preferably a ball bearing rotatably mounted to cam follower arm 93 which is mounted rigidly with respect to upper arm 82.

Figure 5:
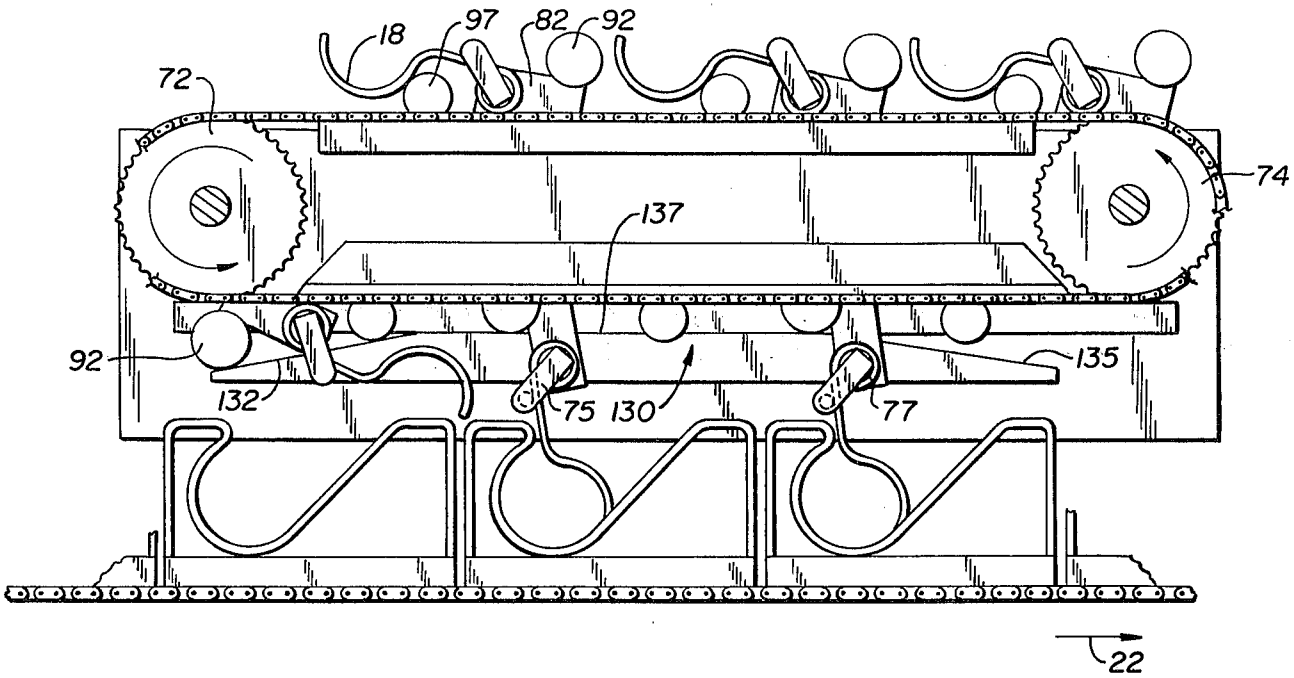
FIG. 5 is an elevational schematic view showing the cam engagement for lowering the bunching arms into the pocket flights.

Additional reference should be made to the elevational view of FIG. 5. A cam bar 130 extends longitudinally along the direction of travel so as to engage cam follower bearing 92 shortly after bunching arm assembly 17 has passed over upstream sprocket pair 72 and begun its travel in the downstream direction. Cam bar 130 contains a first upstream ascending ramp portion 132, a second downstream descending ramp portion 135, and an intermediate level portion 137. As cam follower bearing rides up on ramp portion 132, upper arm 82 is caused to move from its retracted position generally parallel to the direction of motion into a generally downward orientation as it continues to move downstream. Upper arm spring 85 maintains contact between cam follower bearing 122 and cam bar 130 and causes upper arm 82 to move back to its retracted position once cam follower bearing 122 has passed level cam bar portion 137.

As upper arm 82 is urged downward, it carries lower arm mounting 75 downward with it. In this position, bunching arm spring 77 causes bunching arm 18 to engage the broccoli spears in the underlying pocket flight and to urge them into a tight configuration. Spring 77 forces bunching arm with about 20 pounds force into the bunch, regardless of possible size variations among individual bunches. Once the 20 pounds force is reached, the bunching arm rotates relative to upper arm 82, working against bunching arm spring 77, and moving off stop pin 118 as far as required by the bunch size.

Figures 6, 7:
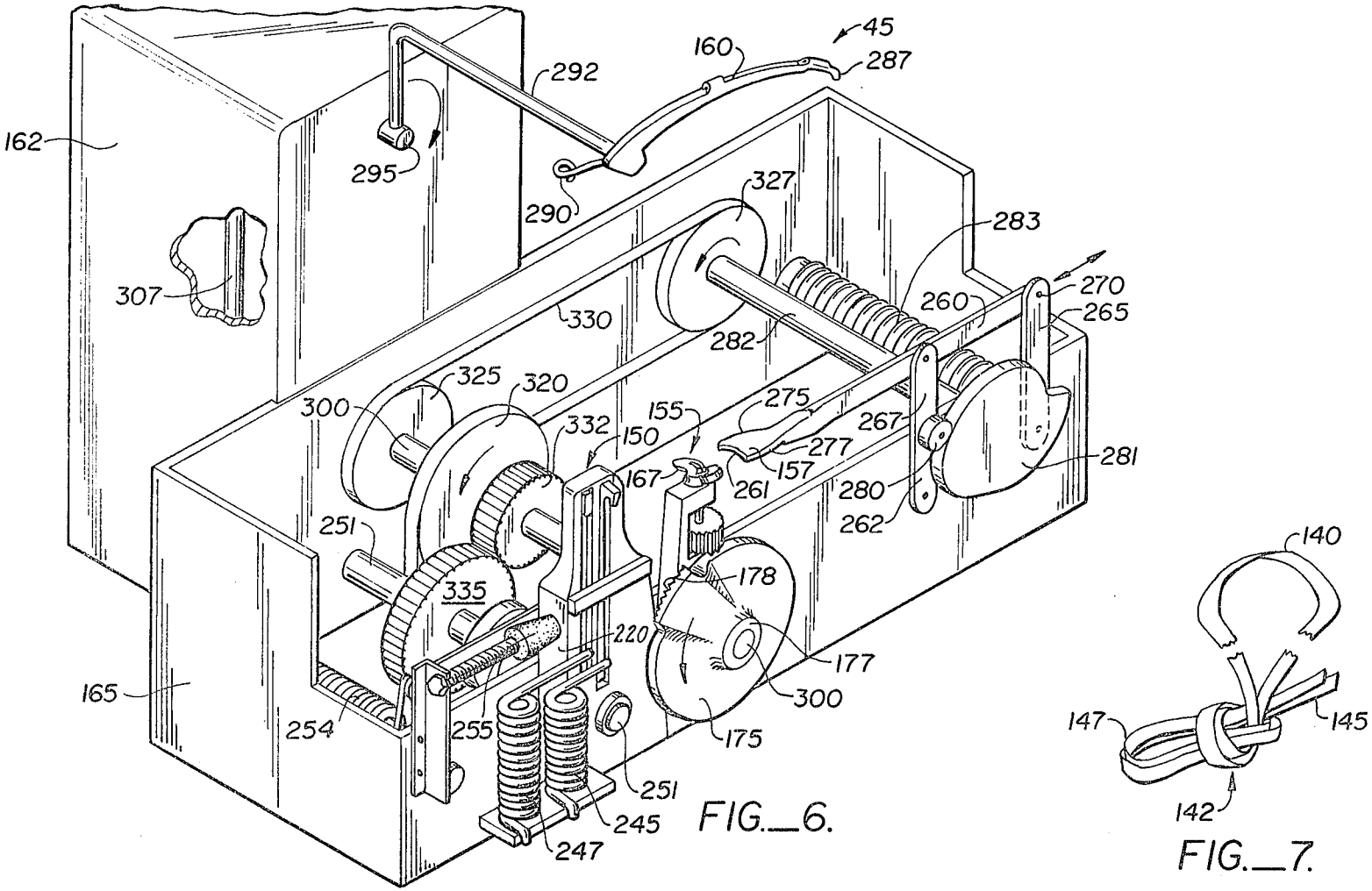
FIG. 6 is an isometric schematic view showing the main components of an automatic tying machine for use with the bunching machine.
FIG. 7 shows a knotted loop formed by the tying machine of FIG. 6.

FIG. 6 is an isometric view of the main components of automatic tying machine 45 constructed according to the present invention. The purpose of tying machine 45 is to tie a loop of string around the bunched spears. The finished tied loop is shown in FIG. 7, and comprises a loop 140, a knot 142, and ends 145. Knot 142 is in fact a slip knot, itself having a small loop 147. While tying machine 45 is especially well suited for tying the irregularly shaped broccoli bunches, it also works very effectively in other applications such as tying the leaves of growing cauliflower heads to protect the heads from the sun. In such an application, the product is stationary but the tying machine is actually moved in the field.

Broadly, tying machine 45 comprises a string retaining mechanism 150, a knotting mechanism 155, a placer foot 157, and a string carrying needle 160. As will be described below, these components are driven in a predetermined time sequence by appropriate mechanical linkages located within a needle drive housing 162 and a main tier housing 165 and coupled to main driving means 20 operating the entire machine.

While the operation of tying machine 45 will be described in detail below, the following summary may be set forth pending a detailed description of the various components. String retaining mechanism 150 holds a length of string at one end below and in front of the moving bunch while needle 160 holds the other end of the string above the bunch. Needle 160 then swings down behind and below the bunch to form a loop around the bunch. String retaining mechanism 150 grabs the other end of the string to allow the needle to return as knotting mechanism 155 ties the string ends to form the knotted loop.

Figure 8:
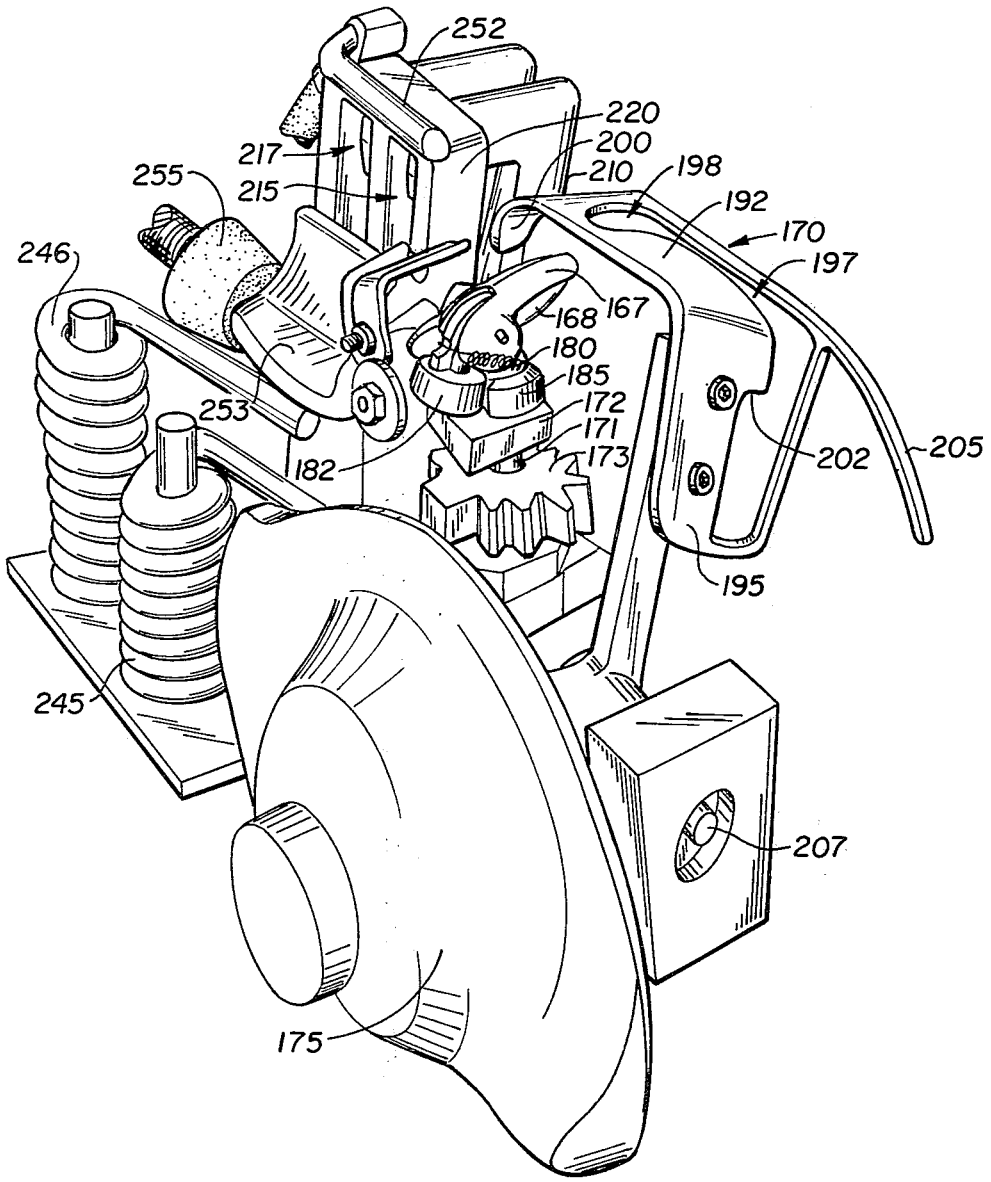
FIG. 8 is a perspective view of the knotting mechanism of the tying machine.

FIGS. 6 and 8 taken together show the construction of knotting mechanism 155 and its associated drive components. The main operative elements include an intermittently rotated knotter bill assembly comprising first and second knotter bills 167 and 168, and an overlying sheet metal guide 170 that is moved out of its overlying position at the end of each tying cycle, to assume the position illustrated in FIG. 8. Knotter bill 167 is mounted rigidly to a vertical shaft 171 which is journalled in a knotter frame 172 and carries a pinion 173. Each knotter bill has a string confronting extremity, and knotter bill 168 is rotatably mounted to knotter bill 167 for rotation about a horizontal axis so that it is movable into and out of engagement with knotter bill 167. Pinion 173 engages the teeth of a perpendicularly mounted intermittent gear 175 having a central portion 177 and axially directed teeth 178 on a portion of its circumference. Thus, rotation of intermittent gear 175 effects a 360° rotation of pinion 173 during a limited angular portion of a revolution of gear 175. A knotter bill tension spring 180 urges knotter bill 168 into a normally closed position with respect to knotter bill 167. A cam follower 182 mounted to a portion of knotter bill 168 remote from its string gripping portion cooperates with a knotter bill cam 185 mounted to knotter frame 172 and surrounding shaft 170 in order to open knotter bills 167 and 168 during approximately 120° of rotation of shaft 171.

String guide 170, shown in FIG. 8 but not in FIG. 6, overlies knotter bills 167 and 168. String guide 170 comprises a sheet metal angle having a horizontal portion 192 and a downwardly extending vertical portion 195 on the side of horizontal portion 192 remote from string retaining mechanism 150. Horizontal guide portion 192 has an open-ended slot 197 which extends downwardly into vertical guide portion 195. Slot 197 preferably terminates at one end on horizontal guide portion 192 in a widened generally circular portion 198. A vertical knife blade 200 is mounted to string guide 170 at its end nearest string retaining mechanism 150. Slot 197, as it extends down vertical guide portion 195, widens to define a downwardly facing shoulder 202. A generally elongate member 205 extends from horizontal portion 192 on one side of slot 197 beyond vertical portion 195. Guide 170 is rotatably mounted to the fixed structure at a pivot point 207.

In operation, the two string ends from the loop pass downwardly through widened slot portion 198, under knotter bill 168, and downstream to string retaining mechanism 150 (to be described below). As the knotter bills turn, the string is looped around both knotter bills in their closed position. The knotter bills then open and grip the string at a point between the knotter bills and retaining mechanism 150. The knotter bills then close.

Once the knotter bills have rotated and closed, a cam mechanism (not shown) causes guide 170 to move generally perpendicular to slot 192. This movement has two functions. First as guide 170 moves, knife blade 200 severs the paired strings extending between string retaining mechanism 150 and knotter bills 167 and 168 to define cut ends 145. Second, guide 170 strips the loop of string surrounding knotter bills 167 and 168 off the knotter bills to form slip knot 142. The gripped portion of the string remains between the knotter bills and defines slip knot loop 147. Further movement of guide 170 overcomes the gripping force of knotter bills 167 and 168 to entirely free slip knot loop 147 from the knotter bills.

Figure 9:
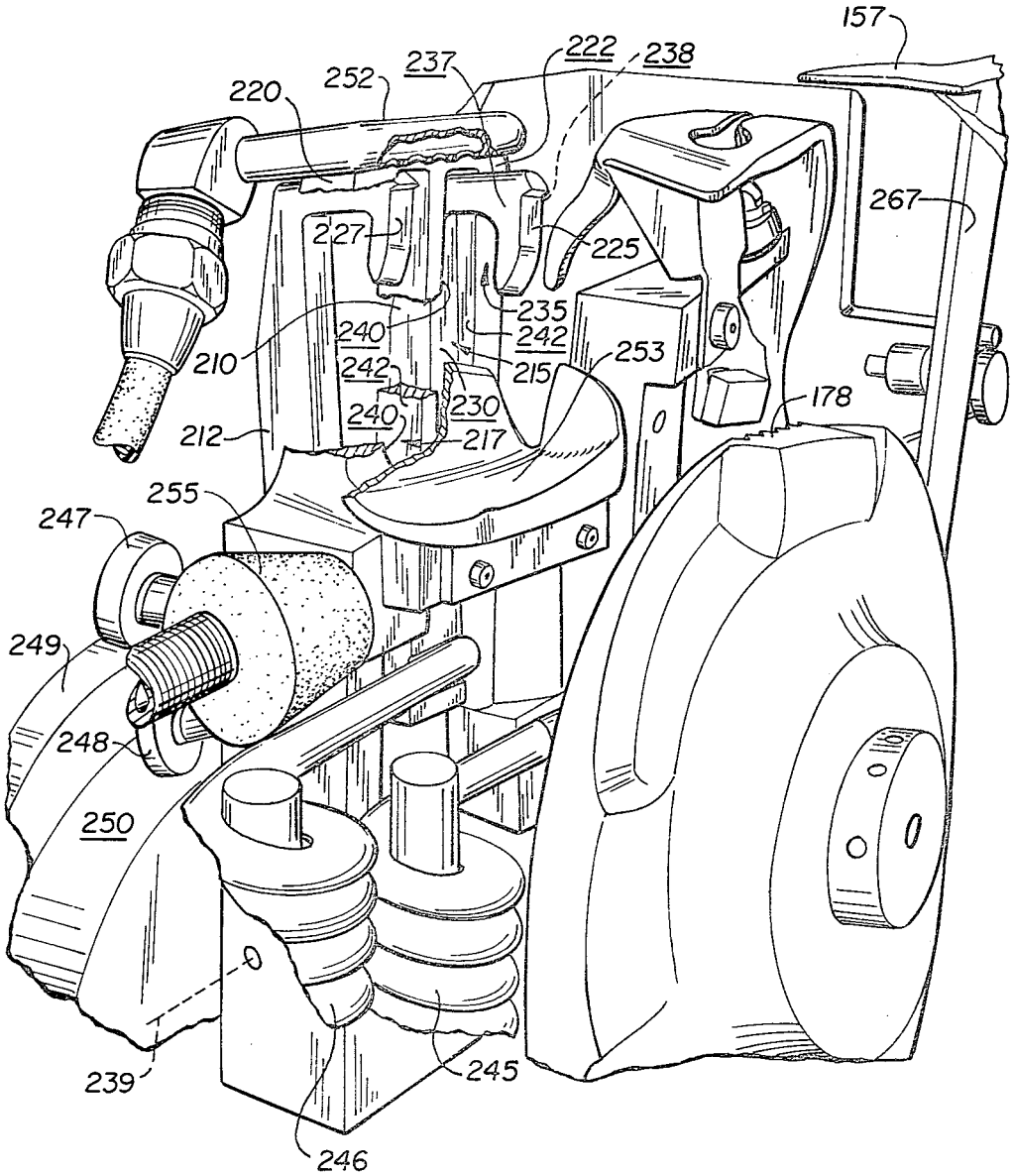
FIG. 9 is a perspective view of the string retaining mechanism of the tying machine.

FIGS. 6 and 9, taken together, show the construction of string retaining mechanism 150 and its associated drive components. String retaining mechanism 150 comprises first and second fingers 210 and 212 which fit into respective slots 215 and 217 in a finger housing 220. Housing 220 has a front surface 222.

Fingers 210 and 212 carry respective finger wedges 225 and 227. Finger 210 has a surface 230 facing wedge 225, with wedge 225 being spaced apart from finger 210 to define a downwardly openly interval 235. Wedge 225 has opposed surfaces 237 and 238 that converge toward finger 210. Finger 210 is pivotally mounted at a lower extremity thereof within housing 220 and rotatable about an axis 239. The rotary motion of finger 210 provides approximately reciprocal motion of finger wedge 225 into and out of slot 215 between a first, so-called "open" position in which surface 230 is generally proximate housing surface 222 and wedge 225 spaced therefrom, and a second, so-called "closed" position in which finger surface 230 is sufficiently removed from housing surface 222 that wedge surfaces 237 and 238 engage inner surfaces 240 and 242 of slot 215. Surfaces 240 and 242 are themselves preferably inclined to mate with wedge surfaces 237 and 238 and may be etched for increased friction. The construction of finger 212 and finger wedge 227 are substantially similar, and will not be further described.

FIG. 9 shows finger 210 in its "open" position and finger 212 in its "closed " position. In the preferred embodiment, slots 215 and 217 extend all the way through finger housing 220 so that in the "closed" position, finger 210 is outside finger housing on the back side thereof. Torsion springs 245 and 246 urges fingers 210 and 212 into their closed positions. Cam followers 247 and 248 are mounted to fingers 210 and 212, respectively, and engage respective cams 249 and 250 which are mounted on a finger cam shaft 251. A source of compressed air communicates with a downwardly opening nozzle 252 mounted to finger housing 220 above fingers 210 and 212 to define a downwardly directed air jet. The air jet impinges on a deflection trough 253 mounted to housing 220 beneath finger wedges 224 and 227.

The entire finger housing assembly including fingers 210 and 212, finger housing 220, and tension springs 245 and 247, is rotatably mounted to main tier housing 165 about finger cam shaft 251, and a finger housing spring 254 maintains finger housing 220 against a stop 255 unless a force in excess of a given predetermined force in a direction toward knotting mechanism 155 is applied.

Referring again to FIG. 6, placer foot 157 is mounted to a horizontal bar 260 which provides horizontal reciprocating movement of placer foot 157 into and out of a so-called "engaged" position wherein placer foot 157 overlies slot 197 on string guide 170, in which position widened slot portion 198 and a concave curved leading edge 261 of placer foot 157 together define a completely surrounded aperture. Note that guide 170 has been omitted from FIG. 6 in order to show knotting mechanism 155 more clearly. To provide reciprocating movement, first and second placer foot arms 262 and 265 are rotatably mounted to main tier housing 165 at a lower end of each, and rotatably mounted to correspondingly spaced points 267 and 270 on placer foot bar 260. In addition to concave curved leading edge 261, placer foot 157 includes first and second longitudinal edges 275 and 277 extending back in a converging manner to merge with bar 260. First placer foot arm 262 carries a cam follower 280 which engages a placer foot cam 281 mounted on a placer foot cam shaft 282. A spring 283 urges placer foot 157 toward its non-engaged position.

Figure 10:
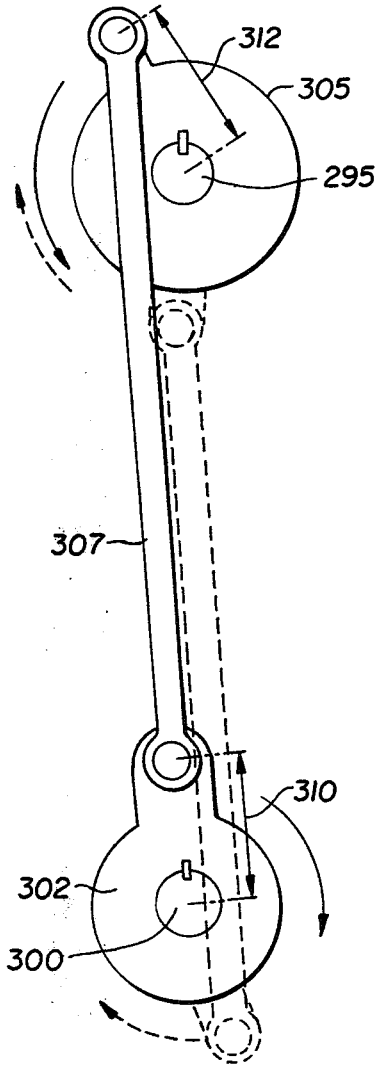
FIG. 10 is an elevational view of the needle actuating mechanism of the tying machine.

FIGS. 6 and 10, taken together, show the construction of needle 160 and its associated drive components. Needle 160 is of generally arcuate configuration and has a generally tubular eye 287 at a first end sized to accomodate string passing therethrough and a second oversized eye 290 at a second end thereof. A supply of string has its free end passed through eye 290 and then through eye 287 to the knotting and string retaining mechanisms. The second end of needle 160 is mounted to an L-shaped support 292, which is mounted to a needle rocker shaft 295. Support 292 is sized so that oscillatory rotation of rocker shaft 295 causes needle 160 to move between an uppermost generally horizontal position above the moving bunches and a lowermost generally horizontal position under the bunches with eye 287 having passed under knotter bills 167 and 168 and beyond finger wedges 225 and 227.

Oscillatory motion of rocker shaft 295 within an angular range of approximately 150° is produced by rotation of a main shaft 300, which shaft also carries intermittent gear 175 mounted thereto. The linkage between main shaft 300 and rocker shaft 295 is located within needle drive housing 162 and includes a main shaft crank 302 mounted to main shaft 300 and a rocker shaft crank 305 mounted to needle rocker shaft 295. A connecting rod 307 is pivotally connected to main shaft crank 302 at a first distance 310 from shaft 300 and to rocker shaft crank 305 at a second, larger distance 312. The relative orientation of cranks 302 and 305 and the length of connecting rod 307 is such that when main shaft crank 302 makes a complete rotation, rocker shaft crank 305 is constrained to one side of vertical to provide oscillatory motion. FIG. 10 shows in solid lines the crank positions when crank 302 is pointing generally up and in phantom lines the crank positions when crank 302 is pointing generally down. A torsion spring, not shown, is fastened at one end to the needle housing and at the other end to shaft 295 in order to urge rocker shaft crank 305 into its generally upwardly directed position. In the preferred embodiment, rocker shaft crank 305 is not rigidly coupled to rocker shaft 295, but rather is coupled to it through a clutch which provides for disengagement in the event that needle 160 encounters an obstruction in its downward travel. When the clutch disengages, the spring causes rotation of the shaft to bring needle 160 back into its uppermost position so that needle 160 is free of the obstruction.

In order to effect a proper tying, fingers 210 and 212, knotter bills 167 and 168, placer foot 157, and needle 160 must be moved in a predetermined synchronous relationship. In particular, a single revolution of shaft 300 is required to carry out a complete tying cycle, and all movements must be keyed to such rotation. Shaft 300 has mounted thereto a main sprocket gear 320 so that rotational motion may be transmitted to shaft 300 from main driving means 20 in order to synchronize operation of tying machine 45 with movement of conveyors 10 and 15. Sprocket 320 is mounted to shaft 300 through a single revolution clutch which may be engaged by a solenoid-activated clutch trip lever (not shown). First and second equal sized sprockets 325 and 327 are mounted on main shaft 300 and placer foot cam shaft 282, respectively, and engage a roller chain looped thereabout in order to transmit motion from shaft 300 to shaft 282. Reduction gears 332 and 335 mounted to main shaft 300 and finger cam shaft 251 produce a 180° rotation of shaft 251 for every complete revolution of main shaft 300.

Figure 11A:
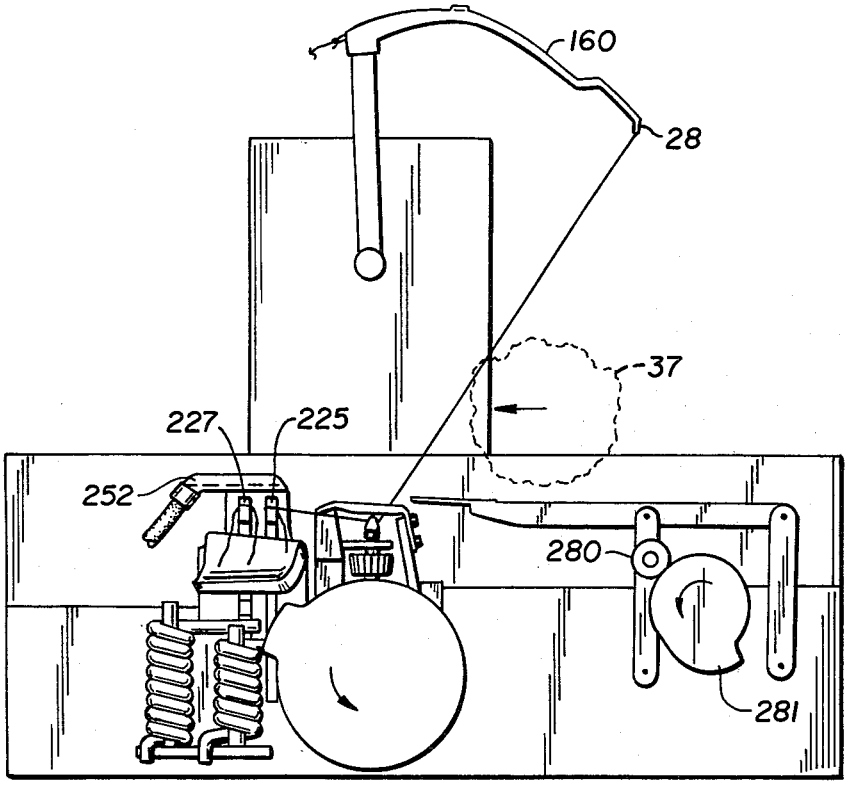
FIGS. 11A–11D are elevational schematic views showing the operation of the tying machine.

Having described the structure of the various mechanisms and their associated drive components, and further having described the linkage therebetween, the operation of tying machine 45 may be understood. FIGS. 11A–11D illustrate in schematic form the sequence of operations. FIG. 11A shows the situation at the beginning of a cycle. Needle 160 is in a generally horizontal position at the upper end of its travel and a string segment 340 extends from eye 287 to the knotter bills in a downward inclined manner, and under knotter bill 168 to first finger wedge 225, passing around wedge 225 and being clamped thereunder. At this point, a short cut piece of string, the origin of which will be described below, is held by second finger wedge 227. Downstream moving bunch 37 is shown about to engage string segment 340.

Figure 11B:
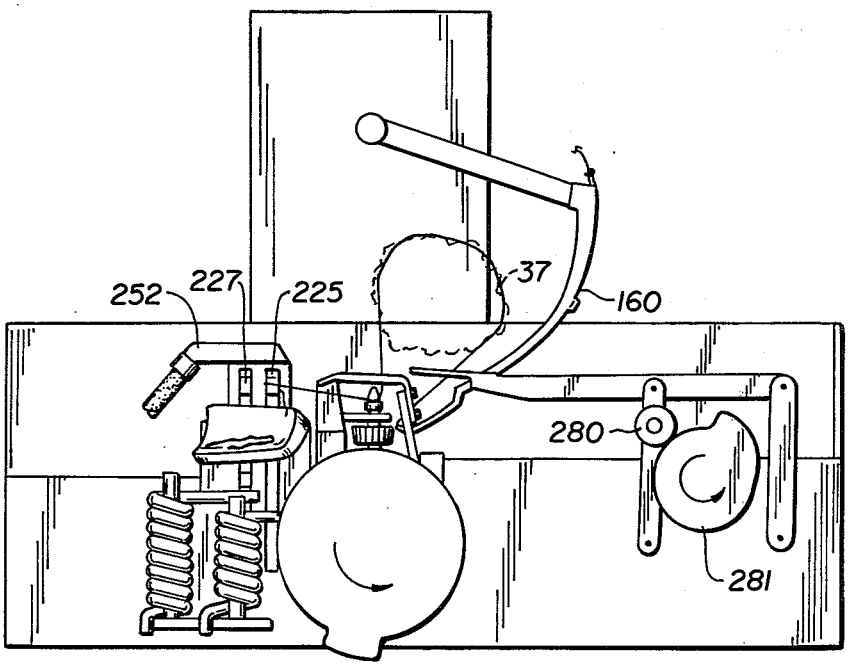

At approximately the same time that bunch 37 engages string segment 340, needle 160 begins its downward travel along an arcuate path, coming down behind and under the moving bunch 37 to encircle it. FIG. 11B shows bunch 37 about to be encircled. During its downward travel, needle 160 must pass along longitudinal edge 275 of placer foot 157. During high speed operation, the string extending from the needle tip to the point where it contacts the upstream side of the moving bunch tends to vibrate, and in the event of an irregularity on the bunch the string may be pulled to the side. Elongate member 205 of string guide 170 insures that the string is guided into the slot ahead of the placer foot to prevent a mistie which would otherwise occur if the string failed to end up in front of concave curved leading edge 261.

Needle 160 continues toward its lowermost position, and in doing so, passes under bunch 37, through the vertical portion of slot 197 underneath shoulder 202 in guide 170, and past both finger wedges. Before the needle reaches the finger wedges, second wedge 227 is pushed into its "open" position by its respective cam follower 248 having engaged a raised portion on cam 250. Cam 249 of first finger wedge 225 has a corresponding raised portion for opening finger wedge 225, but this raised portion does not engage cam follower 247 during the 180° rotation of finger cam shaft 251 that occurs during this particular cycle. When finger wedge 227 moves to its open position, finger 212 positively ejects from slot 217 the cut piece of string being held by wedge 227, and the jet of air from nozzle 252 blows the cut piece of string downwardly into deflection trough 253 and away from the machine. The needle tip passes by wedge 225 (which has remained closed) and passes through the open interval between wedge 227 and front surface 222 of housing 220.

Figure 11C:
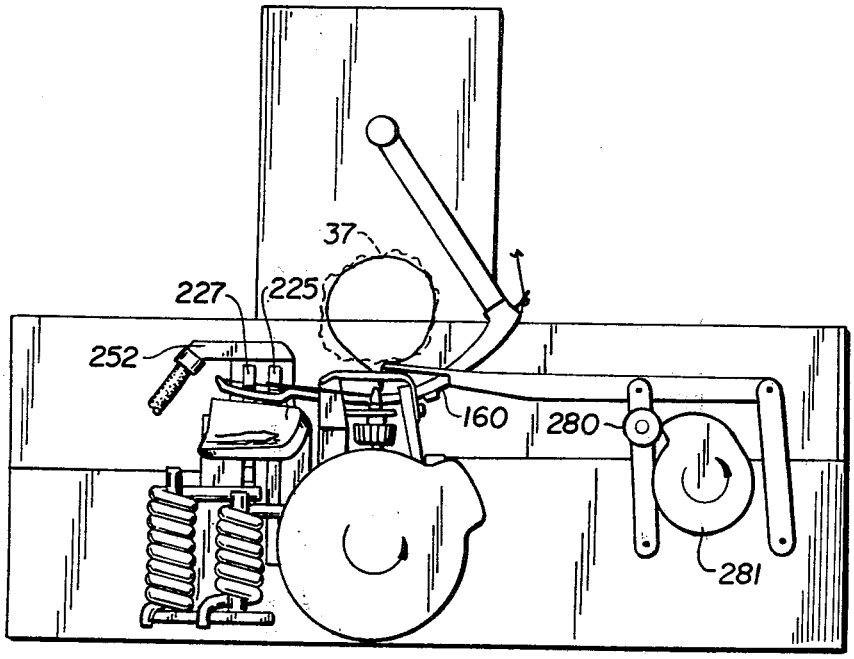

Once needle 160 is past the finger wedges, as is shown in FIG. 11C, second finger wedge 227 closes onto the string as its respective cam follower rides off the raised portion. At this point, the product is completely encircled by a loop of string, one end which is clamped by first finger wedge 225 (terminating therebeyond), and the other end of which is clamped by finger wedge 227 (continuing on through to needle 160). At approximately the same time as finger wedge 227 closes, placer foot cam follower 280 encounters a sharply rising portion on cam 281 to quickly drive placer foot 157 to its engaged position overlying guide 170.

Figure 11D:
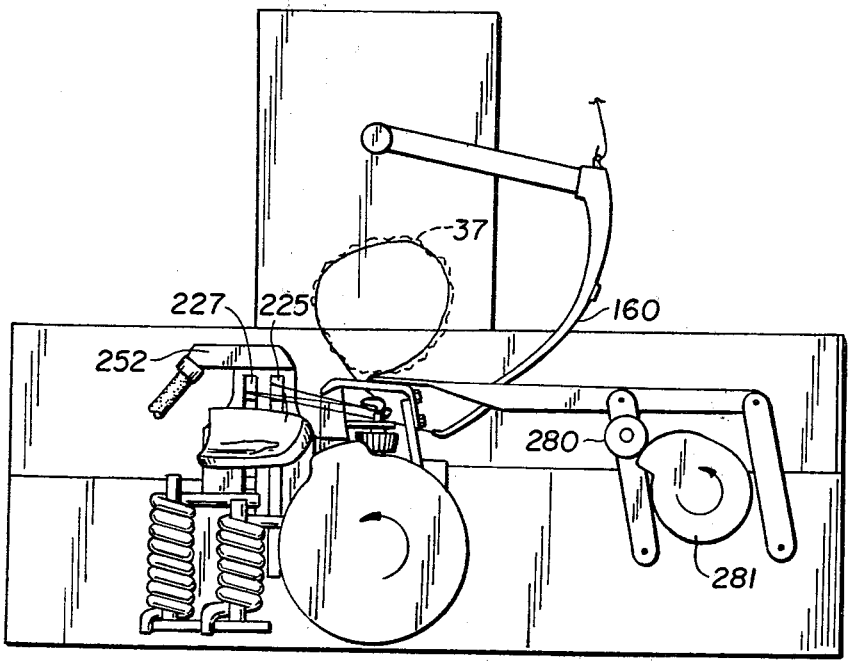

Needle 160 then begins its upward travel, following the path that brought it into position on the downward part of its travel. Teeth 178 on intermittent gear 175 then engage pinion 172 to rotate the knotter bill mechanism and effect the knotting operation described above. At this point the moving bunch is centered over the knotter bills. Once the knotter bills stop rotating and needle 160 has moved back so that it no longer extends through slot 197, as shown in FIG. 11D, guide 170 moves transversely in order to strip the string off the knotter bills and effect the actual knot formation. Prior to the knot's being stripped, the transverse movement causes knife blade 200 to sever the two lengths of string held taut between the two finger wedges and the knotter bills. However, shoulder 202 maintains the length of string extending from the needle tip to second finger wedge 227 below the knife blade so that it is not severed. Finger wedge 225 is thus left holding a short cut piece of string.

With the needle at the top of its travel, a new cycle of tying may begin. The components are in the same positions as at the beginning of the cycle (FIG. 11A) except that the string extending from the needle has its end clamped by second finger wedge 227 whereas at the beginning of the cycle just described, the end of the string was held by finger wedge 225. Similarly, finger wedge 225 clamps a cut piece of string whereas at the beginning of the cycle, a corresponding cut piece was held by wedge 227. In the next cycle, it will be first finger wedge 225 that opens to eject the cut piece of string as the needle commences downward.

With respect to the sectional view of FIG. 3, it can be seen that tying machine 45 is mounted proximate conveyor 10 such that intermittent gear 175 is located generally underneath pocket flight flange 55 with central gear portion 177 almost in the plane of chain 60. Main tier housing 165 is positioned so that it extends into the loop formed by plastic chain 62 with string holding mechanism 150 and tying mechanism 155 protruding upwardly between chains 60 and 62 at a position that is relatively close to the outermost confines of pocket flights 12. String guide 170 must contact the bottom of the bunch in order to tie a tight bunch. Thus, the tying operation is carried out in a plane as close as is practicable to the pocket flight and with the knotter bill as close as possible to the bottom of the bunch. Since the position of the pocket flight and the movement of the tying mechanism components are synchronized and the bunch is indexed to the relatively fixed rear portion of the pocket, the tying is carried out with the position of the bunch to be tied well known. Due to the non-uniform size and shape of the broccoli spears to be tied, the farther from the pocket flight the tying would be carried out, the less certainty there is respecting the confines of the bunch. Since there is always string and/or the needle passing vertically adjacent the pocket, it is necessary to have the narrow pocket with a separate chain outboard to carry the head ends of the spears. A large combined pocket and clamp assembly would not fit between the plane of tying and the cut ends of the spears.

It is not necessary that every pocket flight be loaded. Rather, the tying operation may be initiated only if a full pocket flight passes the tying station. To this end, a photoelectric sensor 180 may be provided to sense the presence of a bunch within a pocket flight passing the sensor and to initiate the tying operation by activating the clutch trip lever to engage main sprocket gear 320 with main shaft 300.

Thus it can be seen that the present invention provides a broccoli bunching and tying machine whose simplified conveyor structure makes it especially well suited for use in connection with an automatic tying machine and an automatic tying machine suitable for tying moving, irregularly configured bunches. By providing pocket flights that are devoid of clamping elements, a configuration wherein the pocket flights themselves may help guide the product thereinto is achieved. The pocket flights are easier to load than clamp carrying pocket members and permit loading with the heads of the broccoli bunches toward the workers. Thus, the circular saw is on the side of the conveyor remote from the workers, thereby reducing the danger of accident. The independent fingers on the tying machine provide reliable holding of the string ends, the reliability being enhanced by the positive ejection of cut string ends by the fingers. The independent reciprocating placer foot is located out of the way of the bunches and is only brought into position when the needle has completed its travel, thus avoiding misties and the like. While the above description provides a full and complete disclosure of the preferred embodiment of the invention, various modifications, alternate constructions, and equivalents may be employed without departing from the true spirit and scope of the invention. For example, there is no absolute requirement that the bunching arm assemblies be constructed precisely as disclosed. Rather, the dummy shaft and associated elements could be replaced by a suitable detent mechanism on the upper arm pivot shaft. Moreover, while conveyors in the form of horizontally elongate loops in a vertical plane are described, a configuration with the conveyors in horizontal planes is possible. With respect to the tying machine, the various driving mechanisms and mechanical linkages (cams, gears, etc.) may be constructed in other ways to carry out the same basic movements. As an example, rather than opening the finger to receive the string at the beginning of the cycle, the finger cams could be timed to open it near the end of the previous cycle before the string is cut. This would eliminate the short cut pieces of string, but would leave one of the string ends a few inches longer than the other. Therefore, the above description and illustration should not be construed as limiting the scope of the invention, which is defined by the appended claims.

I claim:

1. In a tying machine having means for forming a loop of string and knotting means actuated over a period of the machine's cycle in order to tie a knot in the ends of said loop, an improved string retaining mechanism comprising:

first and second independently actuable string gripping means, each said string gripping means having a first string gripping position adapted to secure a respective one of said ends and a second string releasing position, said first string gripping position of either one of said first and second string gripping means being characterized by a gripping force that is maintained substantially independently of the thickness of string material being gripped by the other of said first and second string gripping means; and alternating actuation means for causing said first and second string gripping means to move from said first position to said second position on alternate cycles.

2. The invention of claim 1 wherein each of said string gripping means comprises:

a wedge;

means defining a slot into which said wedge may partially pass;

means for positioning said wedge in said slot to define said first string gripping position; and means for ejecting said gripped string when said wedge moves out of said slot to define said second string releasing position.

3. The invention of claim 2 wherein each of said positioning means and said ejecting means together comprise:

a finger; and means mounting said wedge to said finger in a spaced apart relationship therefrom such that said finger is recessed within said slot when said wedge is in said slot and is generally proximate a front surface of said slot defining means when said wedge is out of said slot.

4. The invention of claim 3 wherein each of said ejecting means further comprises means for directing an air stream along said finger at the front of said slot.

5. The invention of claim 3 wherein said alternating actuation means comprises:

first and second cams;

means for rotating said cams through one complete revolution during two tying cycles; and first and second cam follower means coupled to said first and second fingers, respectively, for engaging said first and second cams, respectively.

6. The invention of claim 1 or 3 or 5, and further comprising:

guide means overlying said knotting means and defining a slot into which said string may enter;

slot shortening means spaced apart from said guide means and movable toward said guide means to a position partially overlying said slot to define therewith an aperture circumscribed by an end of said slot and a portion of said slot shortening means and;

means for maintaining said slot shortening means in said overlying position during the time that said knotting means is actuated to prevent transverse movement of said string during the tying of said knot.

7. The invention of claim 6, and further comprising an elongate member mounted to said guide means and extending toward said slot shortening means to urge and maintain said string between said slot shortening means and said guide means.

8. The invention of clam 6 wherein said slot shortening means comprises a placer foot.

9. In a tying machine having a string carrying needle for forming a loop of string and knotting means actuated over a period of the machine's cycle in order to tie a knot in the ends of said loop passing thereunder, the improvement comprising:

first and second independent string gripping means, each said string gripping means including a wedge, means defining a slot into which said wedge may partially pass, a finger, and means mounting said wedge to said finger in a spaced apart relationship therefrom such that said finger is recessed within said slot when said wedge is in said slot and said finger is generally proximate of front surface of said slot defining means when said wedge is out of said slot;

first and second cams;

means for rotating said cams through one complete revolution during two tying cycles;

first and second cam follower means coupled to said first and second fingers respectively for engaging said first and second cams, respectively to urge said first and second wedges out of said first and second slots, respectively during alternate cycles of said tying machines;

guide means overlying said knotting means and defining a slot into which said string may enter;

a placer foot spaced apart from said guide means and moveable toward said guide means to define therewith an aperture circumscribed by an end of said slot in the portion of said placer foot; and means for maintaining said placer foot in said position overlying said guide means during the time that said knotting means is actuated to prevent transverse movement of said string during the tying of said knot.

10. The invention of claim 9, and further comprising an elongate member mounted to said guide means and extending towards said placer foot to maintain said string between said placer foot and said guide means.

11. A machine for automatically bunching and tying elongate objects of possibly irregular configuration comprising:

a first conveyor disposed with a portion aligned along a flow path;

a plurality of pocket flights mounted serially on said first cnveyor at predetermined intervals into which individual flights a plurality of the objects to be bunched is inserted, said pocket flights being generally devoid of clamping elements thereon;

a second conveyor mounted above said first conveyor along a portion of said flow path;

a plurality of bunching arm assemblies mounted serially on said second conveyor at said same predetermined intervals;

means for driving said first and second conveyors in a synchronized fashion such that the portion of said first conveyor along said portion of said flow path and the portion of said second conveyor along said portion of said flow path are driven in the same direction at the same speed wherein a given has associated with it a particular bunching arm assembly during the time it is passing along said portion of said flow path flight under said second conveyor;

each said bunching arm assembly including object engaging means movable into operative engagement with its associated underlying pocket flight to urge elongate objects within the pocket of said pocket flight into a tight bunch;

means for causing said object engaging means to move into operative engagement with said pocket flights passing thereunder;

a string carrying needle for forming a loop of string about a bunch passing thereby;

knotting means actuated over a period of the machine's cycle in order to tie a knot in the ends of said loop, said knotting means having a portion that extends beyond the plane of said loop, said extending portion being disposed underneath a portion of said pocket flights passing thereby, to permit said loop of string to be formed in a plane proximate said pocket flight;

first and second independently actuable string gripping means, each said strong gripping means having a first string gripping position adapted to secure a respective one of said ends and a second string releasing position, said first string gripping position of either one of said first and second string gripping means being characterized by a gripping force that is maintained substantially independently of the thickness of string material being gripped by the other of said first and second string gripping means; and alternating actuation means for causing said first and second string gripping means to move from said first position to said second position on alternate cycles.

12. The invention of claim 1 or 11 wherein each of said string gripping means comprises:

a wedge;

means defining a slot into which said wedge may partially pass;

means for positioning said wedge in said slot to define said first string gripping position.

13. In a tying machine having a string carrying needle for forming a loop of string and knotting means actuated over a period of the machine's cycle in order to tie a knot in the ends of said loop passing thereunder, the improvement comprising:

first and second independent string gripping means, each said string gripping means having a first string gripping position and a second string releasing position;

alternating acutation means for causing said first and second string gripping means to move from said first position to said second position on alternate cycles;

guide means overlying said knotting means and defining a slot into which said string may enter;

slot shortening means spaced apart from said guide means and movable toward said guide means in a manner separate from movement of said needle to assume a position partially overlying said slot to define therewith an aperture circumscribed by an end of said slot and a portion of said slot shortening means; and means for moving said slot shortening means into said overlying position at a particular point in the machine's cycle and maintaining said slot shortening means in said overlying position during the time that said knotting means is acutated to prevent transverse movement of said string during the tying of said knot.

14. The invention of claim 13 wherein said slot shortening means comprises a placer foot.

15. In a tying machine having means for forming a loop of string and knotting means actuated over a period of the machine's cycle in order to tie a knot in the ends of said loop, an improved string retaining mechanism comprising:

first and second independent string gripping means, each said string gripping means having a first string gripping position and a second string releasing position, each said string gripping means including a wedge, means defining a slot into which said wedge may partially pass, means for positioning said wedge in said slot to define said first string gripping position, and means for ejecting said gripped string when said wedge moves out of said slot to define said second string releasing position; and alternating actuation means for causing said first and second string gripping means to move from said first position to said second position on alternate cycles.

16. In a tying machine having means for forming a loop of string and knotting means actuated over a period of the machine's cycle in order to tie a knot in the ends of said loop, an improved string retaining mechanism comprising:

first and second independently actuable string gripping means, each said string means having a first string gripping position adapted to secure a respective one of said ends and a second string releasing position, said first string gripping position of either one of said first and second string gripping means being characterized by a gripping force that is maintained substantially independently of the thickness of string material being gripped by the other of said first and second string gripping means, each said string gripping means including means for positively ejecting gripped string upon movement from said first string gripping position to said second string releasing position; and alternating acutation means for causing said first and second string gripping means to move from said first position to said second position on alternate cycles.

17. A machine for automatically bunching and tying elongate objects of possibly irregular configuration comprising:

a first conveyor disposed with a portion aligned along a flow path;

a plurality of pocket flights mounted serially on said first conveyor at predetermined intervals into which individual flights a plurality of the objects to be bunched is inserted, said pocket flights being generally devoid of clamping elements thereon;

a second conveyor mounted above said first conveyor along a portion of said flow path;

a plurality of bunching arm assemblies mounted serially on said second conveyor at said same predetermined intervals;

means for driving said first and second conveyors in a synchronized fashion such that the portion of said first conveyor along said portion of said flow path and the portion of said second conveyor along said portion of said flow path are driven in the same direction at the same speed wherein a given flight has associated with it a particular bunching arm assembly during the time it is passing along said portion of said flow path under said second conveyor;

each said bunching arm assembly including object engaging means movable into operative engagement with its associated underlying pocket flight to urge elongate objects within the pocket of said pocket flight into a tight bunch;

means for causing said object engaging means to move into operative engagement with said pocket flights passing thereunder;

a string carrying needle for forming a loop of string about a bunch passing thereby;

knotting means actuated over a period of the machine's cycle in order to tie a knot in the ends of said loop, said knotting means having a portion that extends beyond the plane of said loop, said extending portion being disposed underneath a portion of said pocket flights passing thereby, to permit said loop of string to be formed in a plane proximate said pocket flight;

first and second independently actuable string gripping means, each said string gripping means having a first string gripping position adapted to secure a respective one of said ends and a second string releasing position, said first string gripping position of either one of said first and second string gripping means being characterized by a gripping force that is maintained substantially independently of the thickness of string material being gripped by the other of said first and second string gripping means, each said string gripping means including means for positively ejecting gripped string upon movement from said first string gripping position to said second string releasing position; and alternating actuation means for causing said first and second string gripping means to move from said first position to said second position on alternate cycles.

18. The invention of claim 16 or 17 wherein each of said string gripping means comprises:

a wedge;

means defining a slot into which said wedge may partially pass;

means for positioning said wedge in said slot to define said first string gripping position.

19. The invention of claim 18 wherein each of said positioning means and said ejecting means together comprise:

a finger; and means mounting said wedge to said finger in a spaced apart relationship therefrom such that said finger is recessed within said slot when said wedge is in said slot and is generally proximate a front surface of said slot defining means when said wedge is out of said slot.

20. The invention of claim 19 wherein each of said ejecting means further comprises means for directing an air stream along said finger at the front of said slot.

21. The invention of claim 19 wherein said alternating actuation means comprises:

first and second cams;

means for rotating said cams through one complete revolution during two tying cycles; and first and second cam follower means coupled to said first and second fingers, respectively,for engaging said first and second cams, respectively.

* * * * *